United States Patent [19]

Klenter et al.

[11] Patent Number: 4,877,133

[45] Date of Patent: Oct. 31, 1989

[54] END WALL OF MOLDABLE MATERIAL FOR A WOUND ROLL

[75] Inventors: Otto Klenter, Much; Klaus Burk, Overath-Vilkerath, both of Fed. Rep. of Germany

[73] Assignee: Hoechst Aktiengesellschaft, Frankfurt am Main, Fed. Rep. of Germany

[21] Appl. No.: 320,714

[22] Filed: Mar. 8, 1989

[30] Foreign Application Priority Data

Mar. 11, 1988 [DE] Fed. Rep. of Germany ..... 3808065

[51] Int. Cl.[4] ..... B05D 61/00

[52] U.S. Cl. ..... 206/416; 206/415

[58] Field of Search ..... 206/415, 416, 389, 413, 206/414

[56] References Cited

U.S. PATENT DOCUMENTS

| | | | |
|---|---|---|---|
| 2,155,312 | 4/1939 | Houtzaager | 206/415 |
| 3,737,028 | 6/1973 | Carlson | 206/416 |
| 3,942,638 | 3/1976 | Stone | 206/416 |
| 4,201,300 | 5/1980 | Klingaman et al. | 206/416 |
| 4,690,345 | 9/1987 | Cotey | 206/416 |
| 4,732,271 | 3/1988 | Solvatses | 206/416 |

FOREIGN PATENT DOCUMENTS 1991976 5/1968 Fed. Rep. of Germany .

*Primary Examiner*—Joseph Man-Fu Moy

*Attorney, Agent, or Firm*—Foley & Lardner, Schwartz, Jeffery, Schwaab, Mack, Blumenthal & Evans

[57] ABSTRACT

An end wall comprises a central wall body and outer wall parts which surround and enclose the central wall part. The central wall body is of circular design and has a central insertion peg which is provided with V-shaped ridges on its peripheral surface. The outer wall parts have an inward-curving quadrant-shaped abutment surface which has the same radius as the central wall body. On the rear side of the composite plate, junctions are provided along the abutment surfaces of the outer wall parts and of the central wall body, into which junctions connecting pieces are driven. The junctions and the connecting pieces in each case have the outline of double swallowtail.

At its front side, each outer wall part is provided with a locking boss which continues a rounded corner surface and has the same radius as this corner surface. The side walls of the plates are either of smooth design or provided with stacking bosses and stacking pockets.

16 Claims, 5 Drawing Sheets

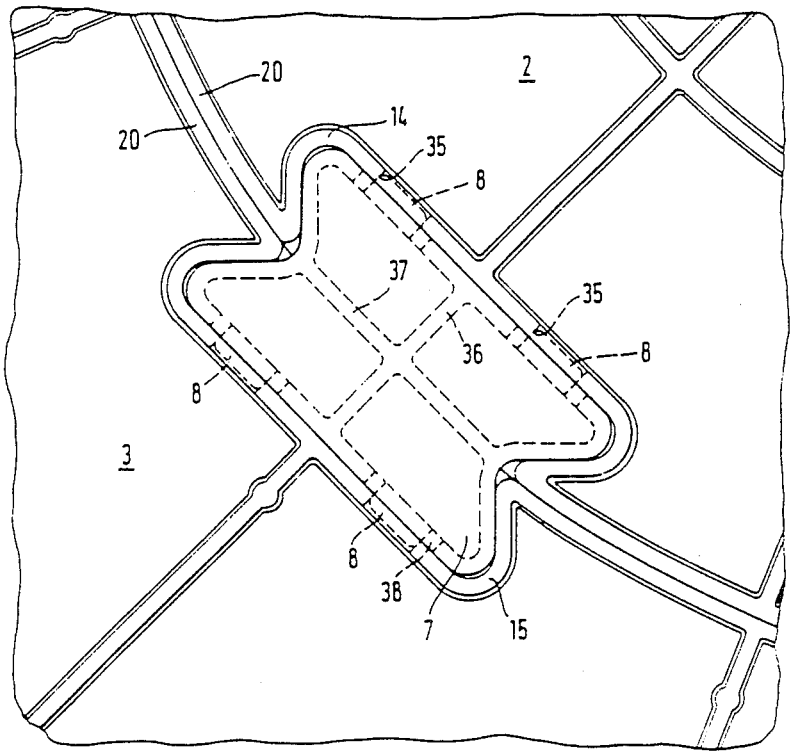
FIG. 5
FIG. 7
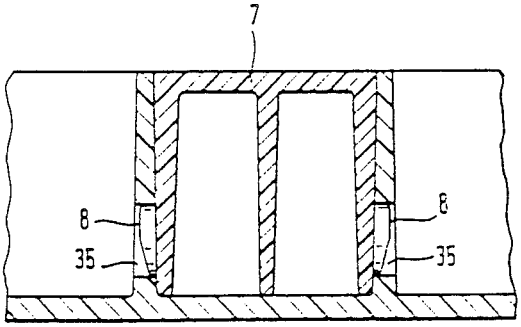

END WALL OF MOLDABLE MATERIAL FOR A WOUND ROLL

BACKGROUND OF THE INVENTION

The invention relates to an end wall of moldable material for a wound roll, having a rectangular, in particular square, plate which has rounded corner surfaces and the front side of which, said front side facing the wound roll, forms a smooth, flat surface and the rear side of which, said rear side facing outwards away from the wound roll, is stiffened by radial and annular ribs, having a central insertion peg and locking bosses on the front side of the plate.

Together with a second, corresponding end wall, an end wall of this kind, of plastic or some other moldable material, forms a rigid overall package for a wound roll, for packaging winding material, for example plastic films or sheets, wound onto take-up rolls.

The other packagings are in general constructed such that additional parts for the central fixing of the wound roll are placed in a box of wood or corrugated cardboard. These additional parts are, inter alia, wooden boards with hubs fitted, perforated discs of plywood, hardboard, greyboard having inserted centering bushes of sheet metal or plastic, or partially ribbed moldings of plastic having integrally molded receiving pegs.

A disadvantage of these known packagings is that they comprise a plurality of individual parts which, in addition, are not connected in a force-locking manner to one another. As a result, in the case of heavy wound rolls, the overall packaging has only low stability.

A disadvantage of the known end wall described at the outset is that, although it can be stacked together with further, horizontally oriented end walls, one above the other, thereby making possible space-saving storage of the end walls, the vertically oriented end walls cannot be stacked, by means of their side walls, in any desired manner next to each other or one above the other and brought into engagement and locked with respect to one another. This means that it is not readily possible to stack ready-packaged wound rolls one above the other by means of the end walls, since the stability of such a stack cannot be guaranteed. If large-sized one-part end walls having dimensions of 600×600 mm and above are produced, the costs of molds for injection molding machines rise disproportionately in comparison to smallsized end walls.

German Utility Model No. 1,991,976 discloses a one-part end wall of plastic which comprises a quadrilateral, preferably square, flat plate stiffened by radial webs. In the center there is an insertion peg for the roll of winding material, said peg being equipped, for example, with retention prisms. The plate is surrounded by a belt, on the outside of which small prismatic strips are arranged. At the corners of the plate, the belt encloses four cup-shaped depressions which protrude into the free hollow space between the winding material and the packaging casing and are open near to the outer end face, and has a circumferential stop strip which is provided with teeth.

SUMMARY OF THE INVENTION

Accordingly, it is an object of the present invention to provide large-sized end walls having dimensions of 600×600 mm and above which can be inexpensively produced.

Another object of the present invention is to provide end walls which can be manufactured in a wide range of sizes using injection molds for smaller sizes.

An additional object of the present invention is to guarantee the mutual locking of the end walls of a plurality of complete rolls which are stacked one above the other and/or next to one another and are terminated by the end walls, the end walls being capable of mutual engagement with each of their side walls without the necessity of making a definite preselection of the orientation of the side walls with respect to one another.

In accomplishing the foregoing objectives, there has been provided, in accordance with one aspect of the present invention, an end wall of moldable material for a wound roll comprising a central wall body and a plurality of outer wall parts adjacently contacting the circumferential surface of said central wall body, wherein said central wall body and outer wall parts form a rectangular plate comprising a front side facing said roll, a rear side facing outward, and a plurality of rounded corner surfaces, wherein said front side comprises a smooth flat surface, a central insertion plug and a plurality of locking bosses, and said rear side comprises a plurality of radial and annular ribs, whereby said rear side is stiffened.

In a preferred embodiment, the central wall body is circular in design and is bounded along its circumferential surface by four outer wall parts and is non-releasably connected to said wall parts by connecting pieces.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawing by which FIG. 5 shows an enlarged detail in plan view of the rear side of a connection point between two adjoining individual parts of the end wall, FIG. 6 shows a perspective view of a connecting piece of the end wall and FIG. 7 shows a sectional view of a connection point between two individual parts of the end wall.

DETAILED DESCRIPTION OF THE PREFERRED EMBODIMENTS

The object of the invention is achieved in accordance with the invention by the fact that the end wall is composed of a plurality of parts, such as a central wall body and a plurality of outer wall parts which rest against the circumferential surface of the central wall body.

The central wall body expediently has a central, hollow cylindrical insertion peg, which is connected via a shoulder to a central cylindrical through-opening on the rear side of the plate, and the diameter of the through-opening is greater than the outside diameter of the insertion peg. In this arrangement V-shaped ridges extend parallel to the longitudinal axis of the insertion peg on the outer surface of the insertion peg, said ridges having a V-shaped cross-section which becomes smaller towards the front side of the plate.

In a further preferred embodiment of the invention, each outer wall part has a rounded corner surface and a cylindrical locking boss which is integrated with the corner surface and has the same radius as the rounded corner surface, an inward-curving, quadrant-shaped abutment surface which adjoins the central wall body lies diagonally opposite the corner surface and has the same radius as the central wall body, and in each case one flat abutment surface which rests against the adjoining outer wall part starts on the two corner edges of the quadrant-shaped abutment surface, the two flat abutment surfaces extending at right angles to one another and each abutment surface enclosing a right angle with an adjoining side wall of the outer wall part.

The multipart end wall according to the invention is especially useful for end wall sizes of 600×600 mm and above. The advantage of the multipart end wall consists in the fact that a central wall body, which functions as it were as a foundation body, can in each case be assembled with four outer wall parts in various sizes, and costs for injection molds can thus be saved to a considerable extent by this possibility of combination.

The expenditure for the manufacture of the individual parts and the assembly of these individual parts to give the finished end wall is far less than the expenditure involved in the manufacture of the end wall from one piece. By virtue of the low individual weights of the individual parts, small and economically operating injection molding machines can be used and the mold costs for the end walls are substantially less than costs for molds which make it possible to manufacture an end wall of the same dimensions in one piece.

A comprehensive range of sizes of end walls can thus be manufactured more cheaply in relation to the mold costs of the injection molding machine, since, in addition to the smaller molds, there is also the advantage that a central wall body whose size remains the same can be combined with outer wall parts of different sizes, it being necessary for an injection mold to be newly prepared in each case only for each additional size of the outer wall parts.

Figure 1:
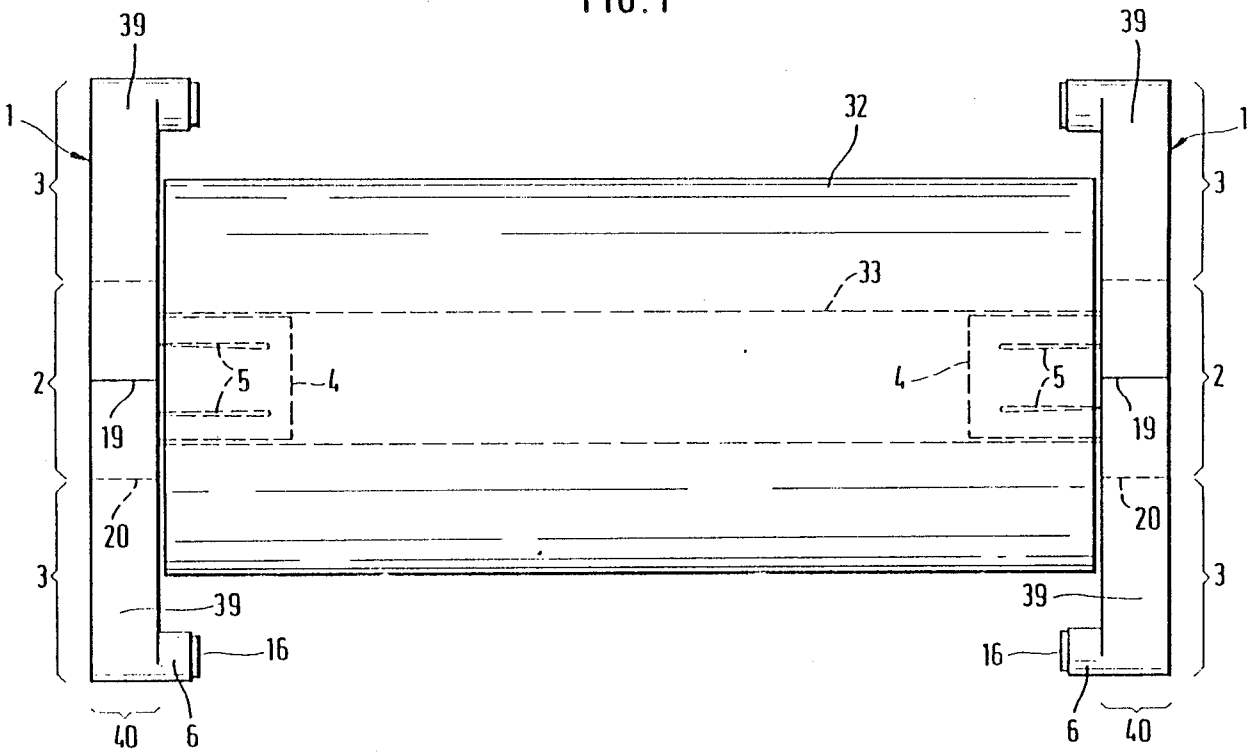
FIG. 1 shows schematically a wound roll which is wound onto a winding core and is bounded by end walls in accordance with the invention.

Referring to the drawing, a complete wound roll 32 which is wound onto a winding core 33 is represented schematically in FIG. 1. The end faces of the wound roll 32 are bounded by end walls 1 of a first embodiment, of which each has a central insertion peg 4 which is pushed into the winding tube 33. The end wall 1 comprises a composite rectangular, in particular square, plate 40, at the four corners of which locking bosses 6 are arranged which merge into boss necks 16. The four side walls 39 of the composite plate 40 of the end wall 1 are smooth.

Figure 2:
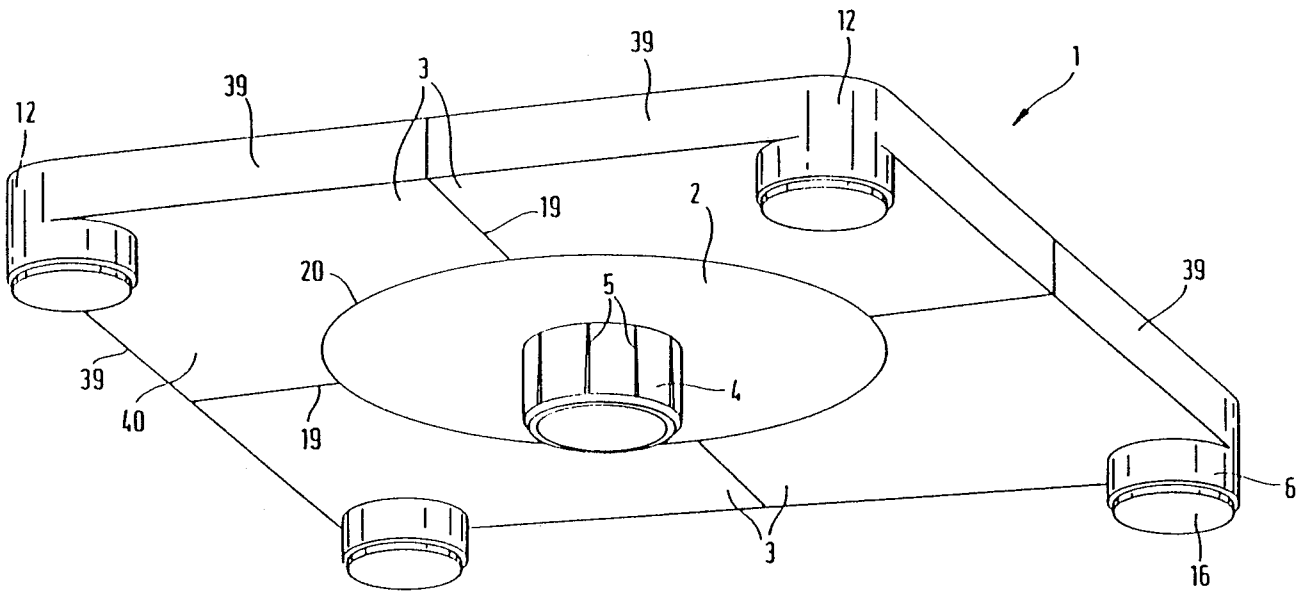
FIG. 2 shows a perspective view of the front side of one embodiment of the end wall in accordance with the invention.

As can be seen from the perspective view of the front side of the end wall 1 in FIG. 2, the composite plate 40 comprises a central wall body 2 and a plurality of outer wall parts 3 which rest against the circumferential surface of the central wall body 2. The central wall body 2 is of circular design and is bounded along its circumferential surface by the four outer wall parts 3. As will be described in greater detail with reference to FIG. 3, the central wall body and the four outer wall parts 3 are connected non-releasably to one another by connecting pieces 7. The central wall body 2 bears the centrally arranged hollow cylindrical insertion peg 4, which is connected to a central cylindrical through-opening 13 (see FIG. 3) on the rear side of the plate 40 via a shoulder 34. The diameter of the through-opening 13 is greater than the outside diameter of the insertion peg 4. Each outer wall part 3 has a rounded corner surface 12, with which a cylindrical locking boss 6 is integrated which has the same radius as the rounded corner surface 12. An inward-curving quadrant-shaped abutment surface which adjoins the central wall body 2 lies diagonally opposite the corner surface 12. This inward-curving abutment surface 20 has the same radius as the central wall body 2. One flat abutment surface 19 which rests against the adjoining outer wall part in each case starts from the two corner edges of the quadrant-shaped abutment surface 20. The two flat abutment surfaces 19 extend at right angles to one another, and each of the two abutment surfaces 19 encloses a right angle with an adjoining side wall 39 of the outer wall part 3. In other words, this means that an outer wall part 3 is bounded by a rounded corner surface 12, two side walls 39, two abutment surfaces 19 and an inward-curving, quadrant-shaped abutment surface 20.

The cylindrical boss necks 16 are set off from the retention bosses 6 by a shoulder.

The smooth or plane front side of the plate 40, which faces the wound roll, protects the end face of the wound roll, in particular during transportation, against damage.

V-shaped ridges 5 extend parallel to the longitudinal axis of the insertion peg on the outer surface of the insertion peg 4, said ridges having a V-shaped cross-section which becomes smaller towards the front side of the plate 40.

The insertion peg 4 is pressed into the bore of the winding tube (see FIG. 1). The V-shaped ridges 5 on the insertion peg 4 guarantee a better grip of the insertion peg in the winding core 33 and compensate for dimensional tolerances of the winding core on the one hand and of the insertion peg on the other. The diameter of the hollow cylindrical insertion peg 4 is matched to the diameter of the respective bore of the winding core 33.

Figure 3:
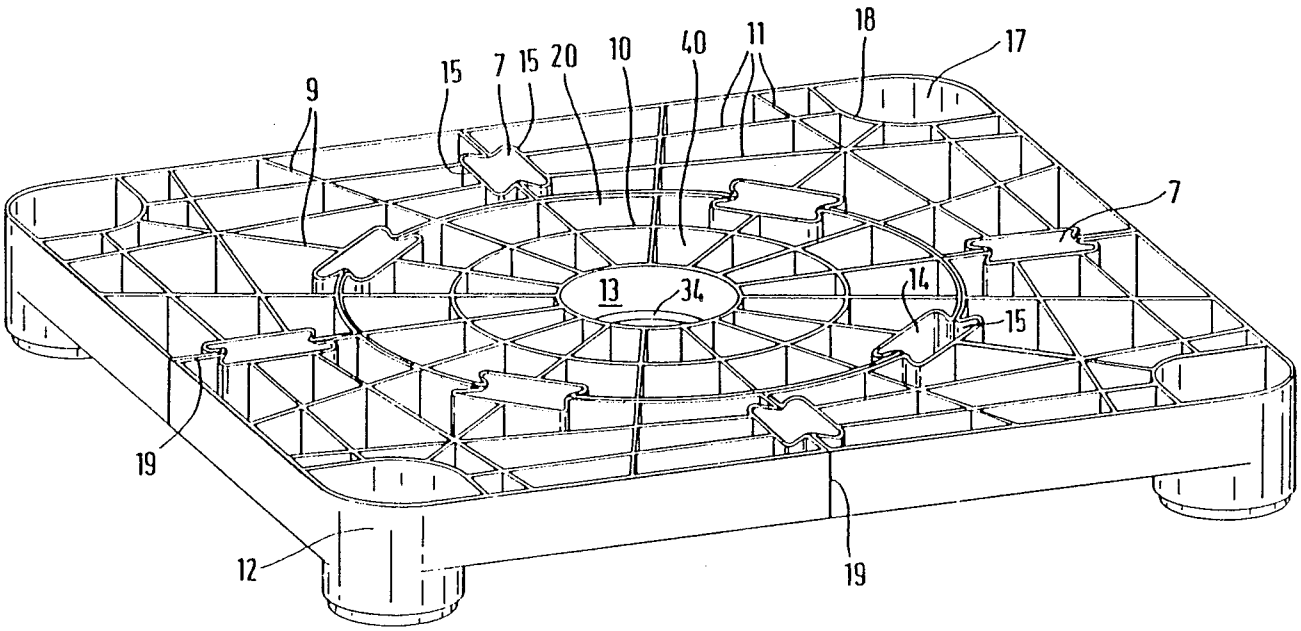
FIG. 3 shows a perspective view of the rear side of the end wall according to FIG. 2.

From the perspective view in FIG. 3 of the rear side of the end wall 1, which faces outwards and away from the wound roll, it can be seen that the individual parts of the end wall 1 are equipped with radial ribs 9, annular ribs 10 and longitudinal and transverse ribs 11, which stiffen the rear side and avoid large wall thicknesses, with the result that the individual weight of the end wall 1 can be kept low. As a result of these ribs, the end wall 1 has a high load-bearing capacity while having a low overall weight.

On the rear side of the composite plate 40 are recesses 14, which are distributed over the circumferential surface of the central wall body and, for example, have the shape of a swallowtail. On the rear side, along the inward-curving, quadrant-shaped abutment surface 20 and the two abutment surfaces 19, each outer wall part 3 has a recess 15, which like-wise has a swallowtail shape. The mutually opposite recesses 14 and 15 of the central wall body 2 and of the outer wall parts 3 complementarily form a double swallowtail. The same applies to the mutually opposite recesses 15 on the abutment surfaces 19 of two neighboring outer wall parts 3, which likewise have the shape of a double swallowtail. The connecting pieces 7, the configuration of which will be described in greater detail below, are driven into these double swallowtail-shaped recesses of the mutually adjoining outer wall parts 3 and of the respective outer wall part 3 which rests against the central wall body 2. These connecting pieces 7 snap into the recesses and produce a non-releasable connection between the central wall body and the respective outer wall parts and between mutually adjoining outer wall parts, it being possible for the abutment surfaces of these individual parts additionally to be coated with an adhesive in order to further strengthen the mechanical connection by adhesive bonding.

Figure 4:
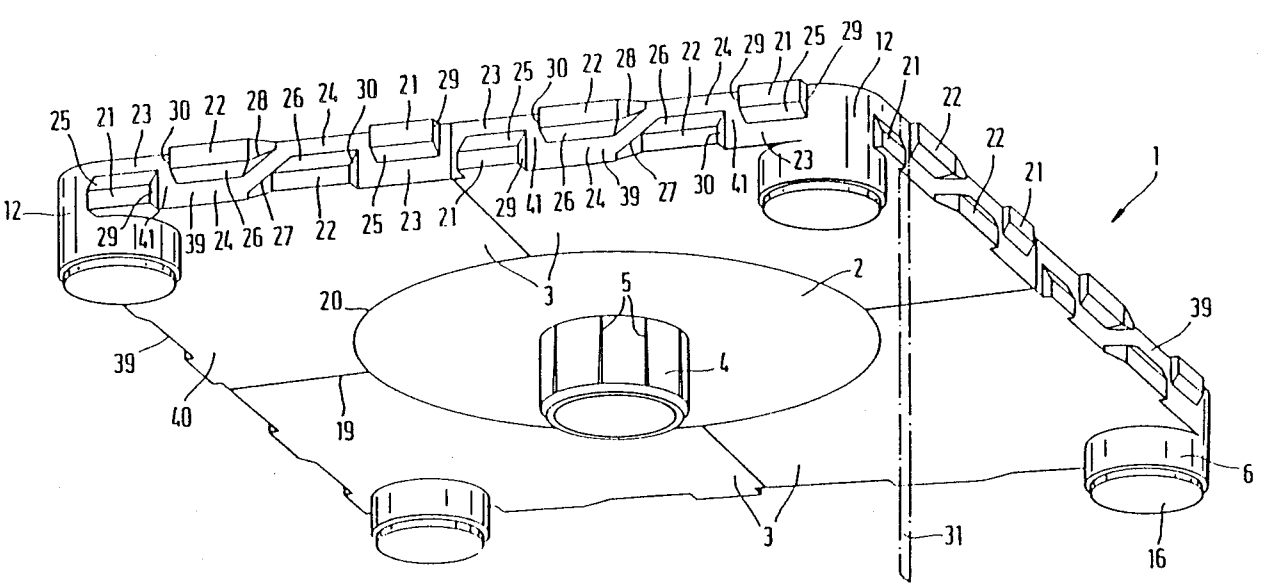
FIG. 4 shows a perspective view of the front side of another embodiment of the end wall in accordance with the invention.

A perspective view of the front side of a further embodiment of the end wall 1 according to the invention is illustrated in FIG. 4. This end wall 1 is distinguished from the embodiment according to FIG. 2 in that the side walls 39 are not smooth but are instead provided with stacking bosses 21 and 22. As can be seen from FIG. 4, the stacking bosses 21 and 22 limit stacking pockets 23 and 24, which are of complementary design to the stacking bosses. The stacking bosses 21 are shorter than the stacking bosses 22. The basic design of the two groups of stacking bosses 21, 22 is in each case cuboid, the one side face 25, 26 of the stacking boss 21, 22 being bevelled and inclined towards the side wall 39. One stacking boss 21 is in each case arranged near to the corner surface 12 and the abutment surface 19 of the side wall 39, the one stacking boss 21 being of a design such that it is rotated by 180° with respect to the other stacking boss 21. The two other stacking bosses 22 of a side wall 39 are likewise rotated by 180° with respect to one another and offset diagonally with respect to one another, as will be described in greater detail below. One stacking boss 21 and 22 in each case is flush, for example, with the lower edge of the side wall 39, while the stacking bosses 22 and 21 rotated by 180° thereto are flush with the upper edge of the side wall 39.

In addition to the bevelled side face 26, the group consisting of the longer stacking bosses 22 has oblique surfaces 27, 28. The mutually opposing stacking bosses 22, 22, which are rotated by 180° with respect to one another, are arranged in such a way that the oblique surfaces 27, 28 lying diagonally opposite one another overlap. By virtue of the oblique surfaces 27, 28, one end face of the stacking bosses 22 runs to a point wedge-fashion, while the end face 30 of the respective stacking boss 22, said end face lying opposite to these oblique surfaces 27, 28, extends perpendicular to the side wall 39. The group comprising the shorter stacking bosses 21 has two end faces 29 per stacking boss, said end faces extending perpendicular to the side wall 39. The mutually opposing spaced end faces 29, 30 of the stacking bosses 21, 22 in each case form the limiting walls for a guide groove 41 which accommodates a strap 31 (indicated schematically in FIG. 4) of the wound roll 32.

There is in each case a plurality of guide grooves 41 on all four side walls 39, said guide grooves being, for example, 20 mm wide and about 10 mm deep.

The two end walls 1 of a wound roll are connected firmly to the wound roll by strapping with straps 31 of plastic or metal. The exact mutual spacing of the guide grooves 41 is selected in such a way that the straps can be applied by a tandem strapping installation. If necessary, the end wall edges can be reinforced at the strapping locations and the guide grooves be provided with the appropriate strength by means of an opposite end wall rib.

The radial ribs 9, the annular ribs 10 and the longitudinal and transverse ribs 11 of the rear side of the plate 40 are on the same level as the outer rims or edges of the side walls 39 of the plate 40. In the exemplary embodiment described, two stacking bosses 21 and two stacking bosses 22 are in each case provided per side wall 39 of each outer wall part 3. At dimensions of 600×600 mm of the end wall, for example, this number of stacking bosses is sufficient, but it is obvious that, in the case of larger end wall dimensions, a correspondingly larger number of stacking bosses 21 and 22 would have to be present per side wall 29 of the individual outer wall part. The number of guide grooves 41 would then also be greater than four.

If two end walls 1 are stacked horizontally one above the other, the boss necks 16 of the locking bosses 6 of one end wall engage in the recesses 17 on the rear side of the plate 40 of the end wall lying thereabove. The insertion peg 4 likewise engages in the through-opening 13, thereby producing the possibility of stacking and palletizing the end walls in a space-saving manner. The recesses 17 are surrounded by round webs 18 and the corner surfaces 12 and, on the rear side adjoin the hollow cylindrical locking bosses 6.

The end walls 1 can be stacked both side by side and one above the other. Since, as mentioned above, the stacking pockets 23, 24 are of a design complementary to the stacking bosses 21, 22, it is possible when stacking laterally together or next to one another and/or stacking the vertically oriented end walls 1 vertically one above the other for the stacking bosses 21, 22 and the stacking pockets 23, 24 of one side wall 39 of an end wall to be fitted together without a gap with the complementary stacking pockets 23, 24 and the complementary stacking bosses 21, 22 of each of the four side walls 39 of the other end walls 1.

The stacking bosses or stacking pockets engage in one another in such a way that a displacement lengthwise or transversely to the sidewall 39 is not possible. The bevelled side faces of the stacking bosses and of the stacking pockets permit problem-free stacking and unstacking of the wound rolls packaged using these end walls. Mutual locking of the complete wound rolls packaged by means of the end walls and stacked one above the other or next to one another is achieved.

The end walls are produced, for example, from thermoplastic plastics by injection molding. Here it is possible to use reclaims and recycling materials. Like the ridges and ribs, the stacking bosses can be formed in the same injection molding operation.

Since all four side walls 39 of an end wall are of identical design with respect to the stacking bosses and stacking pockets, it is possible at any time to stack the wound rolls terminated by the end walls laterally next to one another and/or one above the other, since each side wall of one end wall can be brought into engagement with each side wall of another end wall without the necessity for a preferred orientation of the end walls with respect to one another. In other words, this means that the stacking bosses and stacking pockets engage in or snap into each other in all positions of the end walls, whether vertically or horizontally oriented. Another advantage is that the individual vertically oriented end wall can be conveyed without problems on roller conveyors having a roller spacing of from 60 to 80 mm, since the top surfaces of the stacking bosses 21 and 22 of the individual side walls 39 lie in the same plane and furthermore have a maximum mutual spacing of 20 mm.

In FIG. 5, the enlarged detail in plain view of the rear side of a junction between the central wall body 2 and an outer wall part 3 shows a recess 14 in the abutment surface 20 of the central wall body 2. This recess 14 has the shape of a swallowtail. This recess 14 is adjoined by a recess 15 in the abutment surface 20 of the outer wall part 3. This recess 15 likewise has the shape of a swallowtail, with the result that the mutually adjoining recesses 14 and 15 have the outline of a double swallowtail. In the longitudinal walls of the two recesses 14 and 15 there are openings 35, into which bosses 8 of the connecting piece 7 snap. The connecting piece 7 is reinforced by internal webs 36, 37 between its circumferential walls.

Figure 6:
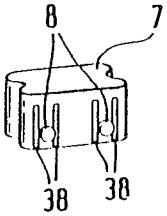

As can be seen from the perspective view of the connecting piece 7 according to FIG. 6, there is a slot 38 on both sides of the tabs which bear the bosses 8. These slots 38 make it possible, when driving the connecting piece 7 into the recesses 14 and 15, for the bosses 8 to spring back initially into the interior of the connecting piece 7 until they have reached the openings 35, into which they subsequently snap, as already mentioned.

FIG. 7 shows in detail a sectional view of a junction along the abutment surfaces of two mutually adjoining outer wall parts. The bosses 8 of the connecting piece 7 have snapped into the openings 35. At one side, the connecting piece 7, which has the shape of a double swallowtail, is open and has a cross-section resembling an E.

The connecting piece 7 can of course also have a different shape to that of a double swallowtail. In that case it is merely necessary for the recesses 14 and 15 in the individual parts of the composite plate 40 to be of a correspondingly complementary design to the external outline of the connecting piece 7.

What is claimed is:

1. An end wall of moldable material for a wound roll comprising a central wall body and a plurality of outer wall parts adjacently contacting the circumferential surface of said central wall body, wherein said central wall body and outer wall parts form a rectangular plate comprising a front side facing said roll, a rear side facing outward, and a plurality of rounded corner surfaces, wherein said front side comprises a smooth flat surface, a central insertion plug and a plurality of locking bosses, and said rear side comprises a plurality of radial and annular ribs, whereby said rear side is stiffened.

2. The end wall as claimed in claim 1, wherein said central wall body is circular and bounded along its circumferential surface by four said outer wall parts and is non-releasably connected to said parts by a plurality of connecting pieces.

3. The end wall as claimed in claim 2, wherein said central wall body comprises said central insertion peg, which is hollow and cylindrical and is connected via a shoulder to a central cylindrical through-opening on the rear side of said plate, and wherein the diameter of said through-opening is greater than the outside diameter of said insertion peg.

4. The end wall as claimed in claim 3, wherein a plurality of V-shaped ridges extend parallel to the longitudinal axis of said insertion peg on the outer surface of said insertion peg, said ridges having a V-shaped cross-section which becomes smaller towards the front side of said plate.

5. The end wall as claimed in claim 2, wherein each of said outer wall parts has a rounded corner surface and a cylindrical locking boss which is integrated with and has the same radius as said rounded corner surface, wherein an inward-curving, quadrant-shaped abutment surface which adjoins said central wall body lies diagonally opposite said corner surface and has the same radius as said central wall body and wherein in each case one flat abutment surface, which rests against an adjoining outer wall part, starts from the two corner edges of said quadrant-shaped abutment surface, the two flat abutment surfaces extending at right angles to one another and each abutment surface enclosing a right angle with an adjoining side wall of said outer wall part.

6. The end wall as claimed in claim 2, wherein said connecting pieces are reinforced by internal webs between the circumferential walls of said pieces, and wherein, at the longitudinal outer sides of said circumferential walls a boss is arranged on each of a plurality of tabs which are bounded on each side by a slot, allowing said tabs to execute a spring action with respect to said circumferential walls.

7. The end wall as claimed in claim 6, wherein, on said rear side, the circumferential surface of said central wall body comprises a plurality of recesses each of which is provided with a plurality of openings in its longitudinal wall for acceptance of said bosses of one of said connecting pieces, and said inward-curving, quadrant-shaped abutment surface and said two abutment surfaces of each said outer wall part comprises a recess which is provided with a plurality of openings in its longitudinal wall for the acceptance of said bosses of one of said connecting pieces.

8. The end wall as claimed in claim 7, wherein said recesses in the circumferential surface of said central wall body and in said abutment surfaces are swallowtail-shaped, and wherein the mutually opposed, equal-sized recesses in the abutment surfaces of said outer wall parts and the mutually opposed, equal-sized recesses in the quadrant-shaped abutment surface of said outer wall parts and the circumferential surface of said central wall body form the outline of a double swallowtail.

9. The end wall as claimed in claim 6, wherein said connecting pieces have a double swallowtail-shaped outline.

10. The end wall as claimed in claim 1, wherein a plurality of stacking bosses which limit a plurality of stacking pockets are provided on the two outer side walls of each said outer wall part of said end wall, and wherein said stacking pockets are of complementary design to said stacking bosses.

11. The end wall as claimed in claim 10, wherein said stacking bosses have different lengths and bevelled side faces which are inclined towards said side wall, and wherein pairs of stacking bosses lie flush with the upper and the lower edge of said side wall.

12. The end wall as claimed in claim 11, wherein said stacking bosses have additional oblique surfaces (27, 28), wherein one short stacking boss (21) is disposed adjacent said rounded corner and another short stacking boss is disposed adjacent said flat abutment surface on the side wall of said outer wall part, said two short stacking bosses being rotated by 180° with respect to one another and lying flush with the upper and lower edge respectively of said side wall, and wherein two longer stacking bosses are disposed between said short stacking bosses, are rotated by 180° with respect to one another and are offset with respect to one another such that their diagonally opposing oblique surfaces overlap.

13. The end wall as claimed in claim 12, wherein the mutually opposing, spaced end faces of said stacking bosses extend perpendicularly on said side wall, to form a guide groove for a strap of said wound roll.

14. The end wall as claimed in claim 5, wherein the locking boss of each said outer wall part has a cylindrical boss neck which is set off by a shoulder and is of smaller diameter than said locking boss.

15. The end wall as claimed in claim 14, wherein said locking boss is hollow and cylindrical and, on the rear side of said outer wall part merges into a recess which is surrounded by said rounded corner surface and a round web.

16. The end wall as claimed in claim 1, wherein said plate is square.

* * * * *